US007886389B1

(12) United States Patent
Stitser

(10) Patent No.: US 7,886,389 B1
(45) Date of Patent: Feb. 15, 2011

(54) TAPE DISPENSER HAVING PAPER CUTTER AND RIBBON TOOL

(76) Inventor: Catherine Stitser, 358 River Flow Dr., Reno, NV (US) 89523

( * ) Notice: Subject to any disclaimer, the term of this patent is extended or adjusted under 35 U.S.C. 154(b) by 225 days.

(21) Appl. No.: 12/327,486

(22) Filed: Dec. 3, 2008

(51) Int. Cl.
*B26B 11/00* (2006.01)
*B25F 1/00* (2006.01)

(52) U.S. Cl. ..... 7/160

(58) Field of Classification Search ..... 7/160, 7/129, 132, 135
See application file for complete search history.

(56) References Cited

U.S. PATENT DOCUMENTS 5,205,007 A * 4/1993 Goldstein ..... 7/135
5,564,145 A 10/1996 Goldstein
6,131,223 A 10/2000 Pehkemper et al.
D504,155 S 4/2005 Crawford et al.
2004/0129123 A1 7/2004 Miller
2006/0016153 A1 1/2006 King
2008/0053622 A1 3/2008 Huang

* cited by examiner

*Primary Examiner*—David B Thomas
(74) *Attorney, Agent, or Firm*—Kyle Fletcher

(57) ABSTRACT

The invention is a tape dispenser having a ribbon tool accessory that can be removed from and stored within the tape dispenser. The ribbon tool has both a cutting blade and a ribbon splitter integrated into the tool.

8 Claims, 3 Drawing Sheets

TAPE DISPENSER HAVING PAPER CUTTER AND RIBBON TOOL

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of tape dispensers, more specifically, a tape dispenser(s) with a removable tool that cuts gift wrap paper and ribbon as well as shreds and/or curls decorative ribbon used with gift wrapping.

B. Discussion of the Prior Art

As a preliminary note, it should be stated that there is an ample amount of prior art that deals with gift wrapping tools. As will be discussed immediately below, no prior art discloses a tape dispenser with a removable cutting, shredding, and curling ribbon tool.

The Miller Patent Application Publication (U.S. Pub. No. 2004/0129123) discloses a gift wrap station having a tape dispenser and storage for scissors and the like. However, the tape dispenser does not have a ribbon tool that cuts, shreds, or curls ribbons and wrapping paper.

The Rehkemper et al. Patent (U.S. Pat. No. 6,131,223) discloses a pair of scissors having ribbon shredding and curling tools. However, the scissors and ribbon tools are not an accessory to a tape dispenser.

The Goldstein Patent (U.S. Pat. No. 5,564,145) discloses a cutting tool for ribbon that also has a ribbon curling means. Again, the cutting tool is not an accessory to a tape dispenser.

The Huang Patent Application Publication (U.S. Pub. No. discloses a tape dispenser having a cutting tool stored within the handle. However, the cutting tool does not also curl a ribbon, and the tape dispenser is designed for use with a hand and not for resting upon a flat surface.

The King Patent Application Publication (U.S. Pub. No. 2006/0016153) discloses a gift wrap storage and dispensing unit having storage for a tape dispenser and scissors. However, the tape dispenser of the storage unit does not have a ribbon cutting and curling tool that can be removed and stored therein.

The Crawford et al. Patent (U.S. Pat. No. Des. 504,155) illustrates an ornamental design for a tape dispenser that can accommodate two tape rolls. However, the tape dispenser does not have a cutting tool accessory.

While the above-described devices fulfill their respective and particular objects and requirements, they do not describe a tape dispenser having a ribbon tool that provides for the advantages of the tape dispenser having a ribbon tool. In this regard, the tape dispenser having a ribbon tool departs from the conventional concepts and designs of the prior art.

SUMMARY OF THE INVENTION

The invention is a tape dispenser having a ribbon tool accessory that can be removed from and stored within the tape dispenser. The ribbon tool has both a cutting blade and a ribbon splitter integrated into the tool.

It is an object of the invention to provide a tape dispenser with a removable tool that can cut, shred, and/or curl ribbons and gift wrapping paper.

These together with additional objects, features and advantages of the provide a tape dispenser having a ribbon tool will be readily apparent to those of ordinary skill in the art upon reading the following detailed description of presently preferred, but nonetheless illustrative, embodiments of the provide a tape dispenser having a ribbon tool when taken in conjunction with the accompanying drawings.

In this respect, before explaining the current embodiments of the tape dispenser having a ribbon tool in detail, it is to be understood that the tape dispenser having a ribbon tool is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the tape dispenser having a ribbon tool. It is therefore important that the claims be regarded as including such equivalent construction insofar as they do not depart from the spirit and scope of the tape dispenser having a ribbon tool. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
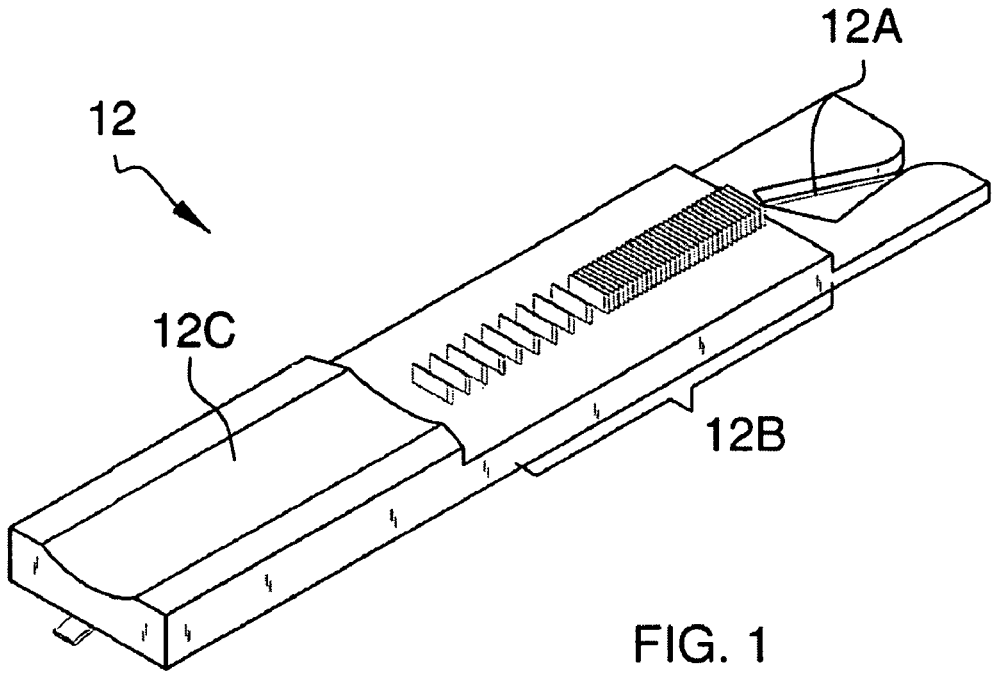
FIG. 1 illustrates a front, isometric view of the ribbon tool.
Figure 2:
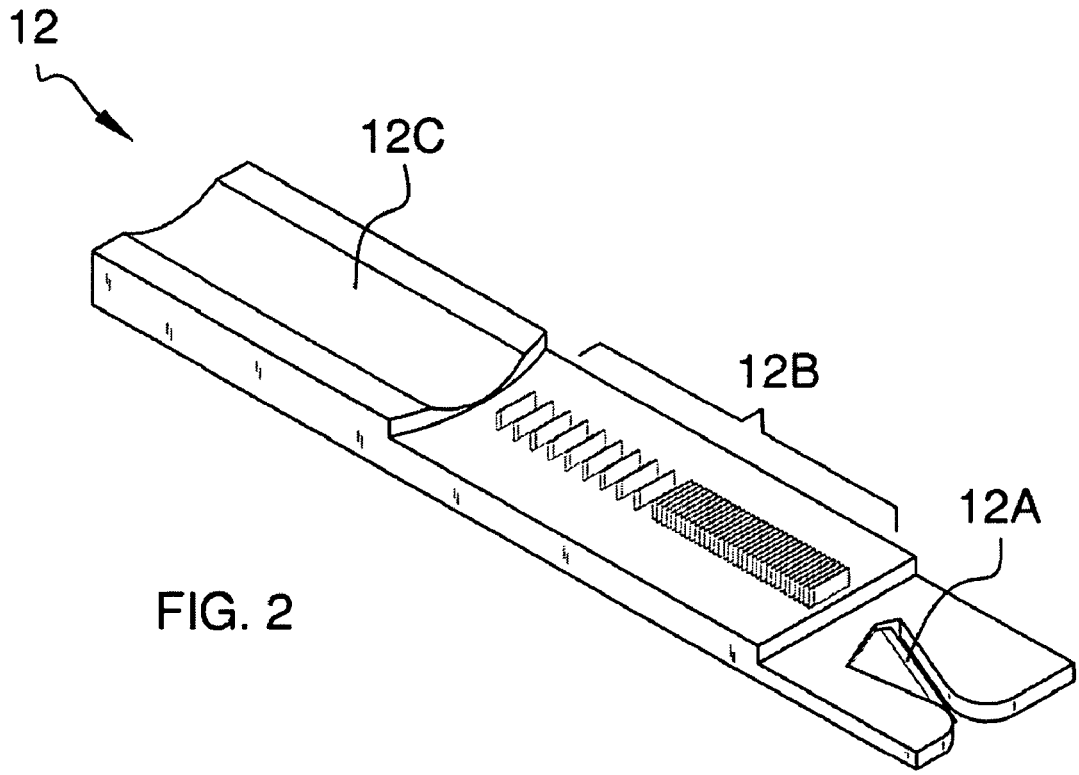
FIG. 2 illustrates a rear, isometric view of the ribbon tool.
Figure 3:
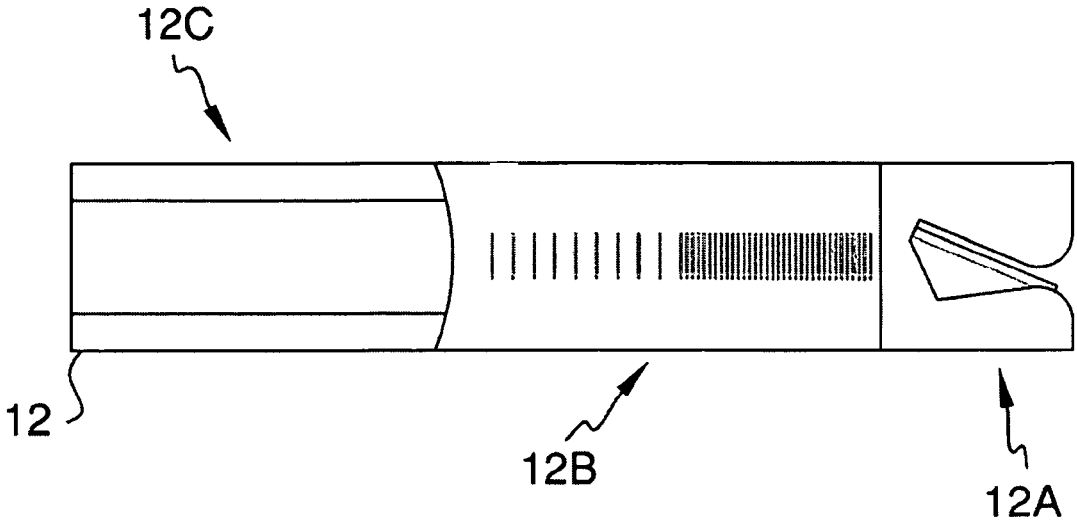
FIG. 3 illustrates a top view of the ribbon tool.
Figure 4:
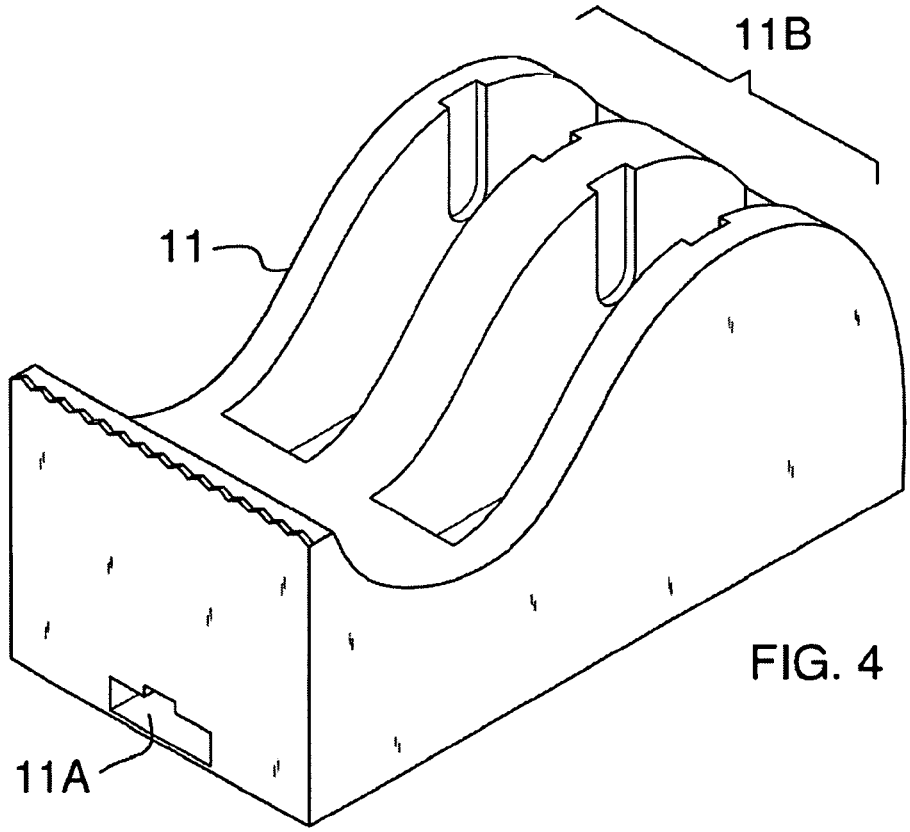
FIG. 4 illustrates a front, isometric view of the tape dispenser.
Figure 5:
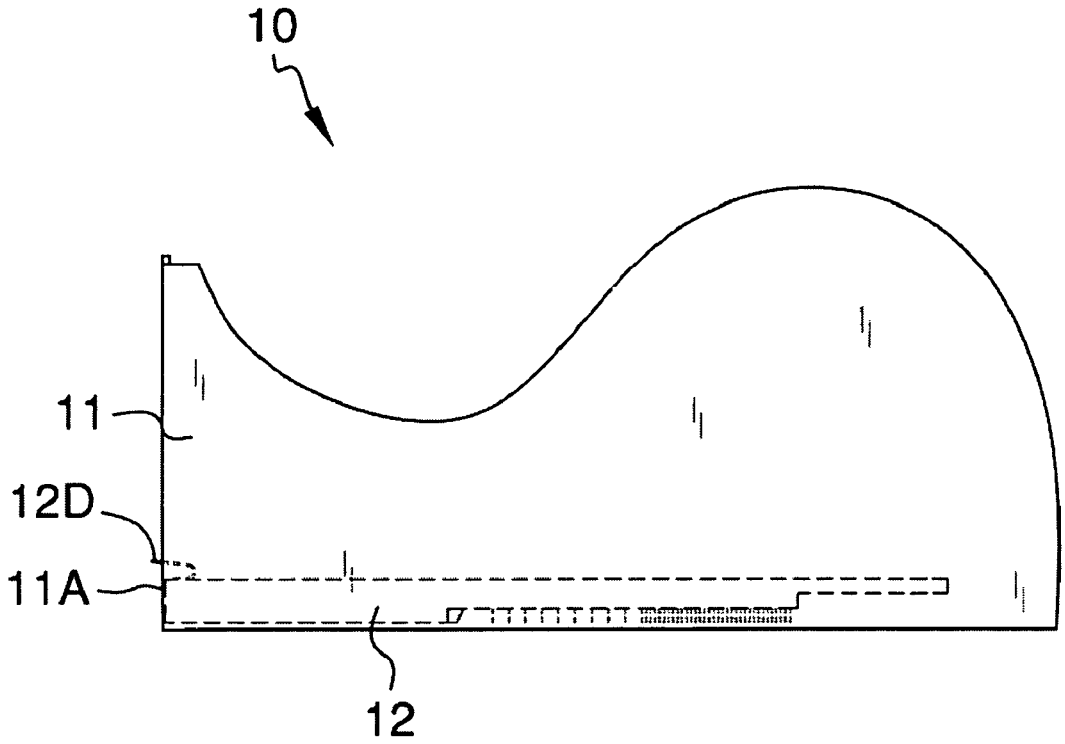
FIG. 5 illustrates a side view of the tape dispenser with hidden lines indicating the location of the ribbon tool as stored within the tape dispenser.
Figure 6:
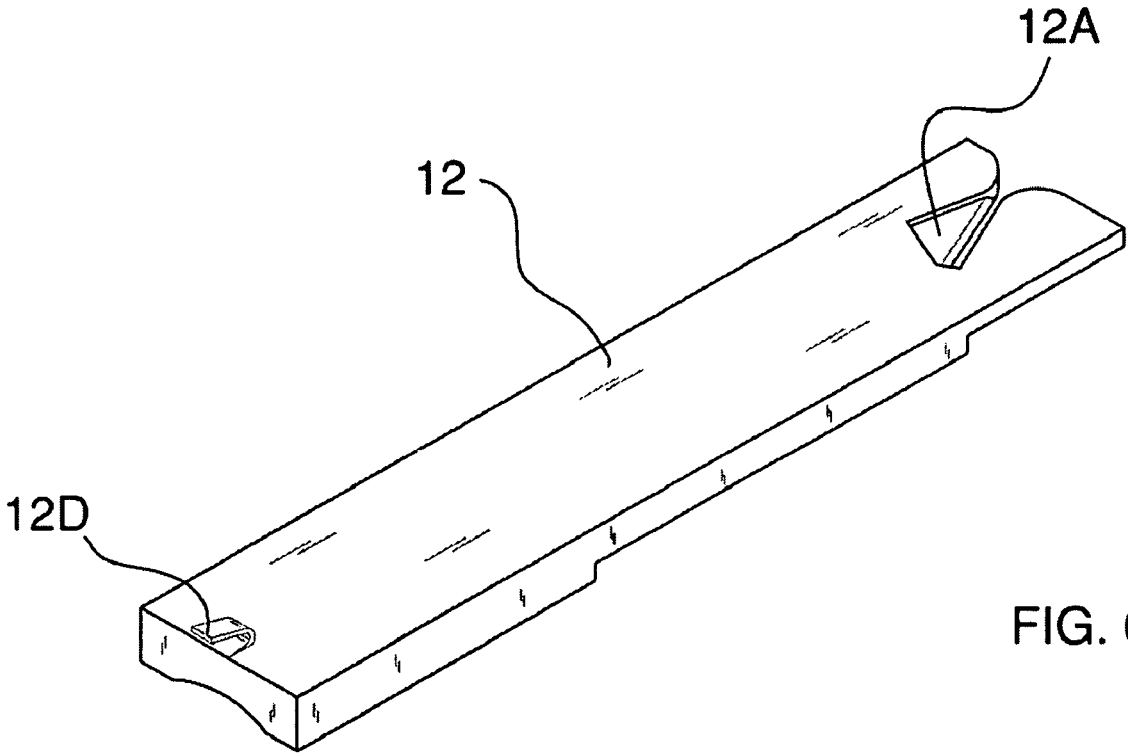
FIG. 6 depicts a bottom, isometric view of the ribbon tool and the locking pin.

Detailed reference will now be made to the preferred embodiment of the present invention, examples of which are illustrated in FIGS. 1-5. A tape dispenser having a ribbon tool 10 (hereinafter invention) comprises a tape dispenser 11 and a ribbon tool 12. The tape dispenser 11 has a slot 11A for the ribbon tool 12 to slide in and out of the tape dispenser 11. It shall be noted that the location of the slot 11A may be placed about any surface of the tape dispenser 11.

It shall be noted that the tape dispenser 11 as depicted shows two tape dispensing slots 11B. The tape dispenser 11 may be designed to provide a single or a plurality of tape dispensers.

The ribbon tool 12 has a blade 12A along one end, and along a top surface has a ribbon splitter 12B. The ribbon splitter 12B is designed to curl a ribbon (not shown). It shall be noted that the location of the blade 12A and the ribbon splitter 12B with respect to each other and the ribbon tool 12, itself may be varied, and is hereby rendered obvious.

The ribbon tool 12 also has a thumb groove 12C, which assists the end user in holding a ribbon (not shown) in order for said ribbon to be run across the ribbon splitter 12B in order to create curls on said ribbon.

The ribbon tool 12 has a locking pin 12D that extends from an end opposite of the blade 12A. The locking pin 12D interacts and snaps into place with the slot 11A to insure that the ribbon tool 12 does not simply slide out of the tape dispenser 11 when not in use. The locking pin 12D can become disengaged with the slot 11A by depressing the locking pin 12D down from the slot 11A, and pulling the ribbon tool 12 out of the slot 11A.

The ribbon tool 12 is made from a material comprising a plastic, metal, or wood. The tape dispenser 11 is made from a material comprising a plastic, metal, or wood. The tape dispenser 11 shall have a sufficient weight so as to provide a stable surface for ease in use.

With respect to the above description, it is to be realized that the optimum dimensional relationship for the various components of the invention 10, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 10.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

While the embodiments of the invention have been disclosed, certain modifications may be made by those skilled in the art to modify the invention without departing from the spirit of the invention:

The invention claimed is:

1. A tape dispenser having a ribbon tool comprising:

(a) a tape dispenser;

wherein the tape dispenser has a slot;

(b) a ribbon tool;

wherein the ribbon tool has a blade;

wherein the ribbon tool has a ribbon splitter and a thumb groove;

wherein the ribbon splitter and thumb groove are used to curl a ribbon; and wherein the ribbon tool fits inside of the slot when not in use;

wherein the ribbon tool has a locking pin that interacts with the slot of the tape dispenser in order to secure the ribbon tool inside of the tape dispenser when not in use;

wherein the ribbon splitter is comprised of a plurality of vertically-extending fins that when pressed against the surface of a ribbon will generate friction thereby curling said ribbon.

2. The tape dispenser having a ribbon tool as described in claim 1 wherein the ribbon tool is made of a material comprising wood, metal, or plastic.

3. The tape dispenser having a ribbon tool as described in claim 1 wherein the tape dispenser is made of a material comprising wood, metal, or plastic.

4. The tape dispenser having a ribbon tool as described in claim 1 wherein the tape dispenser has a plurality of tape dispensers.

5. A tape dispenser having a ribbon tool comprising:

wherein the tape dispenser has a slot;

wherein the ribbon tool has a blade, and a ribbon splitter;

wherein the ribbon splitter is comprised of a plurality of vertically-extending fins that when pressed against the surface of a ribbon will generate friction thereby curling said ribbon; and wherein the ribbon tool fits inside of the slot when not in use.

6. The tape dispenser having a ribbon tool as described in claim 5 wherein the ribbon tool is made of a material comprising wood, metal, or plastic.

7. The tape dispenser having a ribbon tool as described in claim 5 wherein the tape dispenser is made of a material comprising wood, metal, or plastic.

8. The tape dispenser having a ribbon tool as described in claim 5 wherein the tape dispenser has a plurality of tape dispensers.

* * * * *